United States Patent [19]

Balinski

[11] 4,152,878

[45] May 8, 1979

[54] STUD FOR FORMING FIRE-RATED WALL AND STRUCTURE FORMED THEREWITH

[75] Inventor: Henry A. Balinski, Hoffman Estates, Ill.

[73] Assignee: United States Gypsum Company, Chicago, Ill.

[21] Appl. No.: 864,170

[22] Filed: Dec. 27, 1977

Related U.S. Application Data

[63] Continuation of Ser. No. 803,083, Jun. 3, 1977, abandoned, which is a continuation of Ser. No. 580,993, May 27, 1975, abandoned.

[51] Int. Cl.[2] ..... E04B 2/30; E04B 2/78

[52] U.S. Cl. ..... 52/481; 52/729; 52/738; 52/772

[58] Field of Search ..... 52/354–356, 52/481, 484, 492, 495, 496, 497, 729, 735, 738, 772

[56] References Cited

U.S. PATENT DOCUMENTS

| | | | |
|---|---|---|---|
| 1,446,916 | 2/1923 | McElheny | 52/356 X |
| 1,734,685 | 11/1929 | Mays et al. | 52/481 X |
| 3,271,920 | 9/1966 | Downing, Jr. | 52/481 |
| 3,609,933 | 10/1971 | Jahn et al. | 52/481 X |
| 3,702,044 | 11/1972 | Balinski | 52/481 X |
| 3,740,912 | 6/1973 | Sauer et al. | 52/479 |
| 3,839,839 | 10/1974 | Tillisch | 52/481 X |

*Primary Examiner*—Alfred C. Perham
*Attorney, Agent, or Firm*—Samuel Kurlandsky; Glenn W. Ohlson; Robert H. Robinson

[57] ABSTRACT

A metal stud for constructing a fire-rated wall and the wall structure formed of a plurality of studs mounted in runners and having at least a pair of spaced-apart layers of wallboard panels with adjacent panels in abutting relationship, the stud being formed of an integral piece of sheet metal and comprising a single layer web having a first plurality of oppositely directed flange means at one edge thereof and a second pair of oppositely directed flange means connected to the web means at the other end thereof and spaced-apart from the first pair of flange means a sufficient distance to provide a pair of oppositely directed channels receiving the edges of adjacent panels of a single layer, and means extending away from the second pair of oppositely directed flange means and being connected to and supporting a panel spaced apart from the first and second pairs of flange means and adapted to have the wallboard panels of a second layer affixed thereto in parallel spaced-apart relationship with regard to the first layer of wallboard panels. In an improved embodiment a plurality of apertures are provided in the web to reduce heat transfer therethrough and facilitate heat dissipation from the wallboard panels, thereby permitting the wall structure to obtain a favorable ASTM fire rating.

19 Claims, 9 Drawing Figures

STUD FOR FORMING FIRE-RATED WALL AND STRUCTURE FORMED THEREWITH

This is a Continuation application of application Ser. No. 803,083, filed June 3, 1977, now abandoned, which itself is a Continuation application if U.S. Application Ser. No. 580,993, filed on May 27, 1975 now abandoned.

BACKGROUND OF THE INVENTION (1) Field of Invention

The present invention relates to wall constructions, and more particularly refers to studs which may be utilized to form fire-retardant or fire-rated wall structures particularly for use in enclosing open shafts in multi-story buildings such as offices and high-rise apartments, and to the wall structures formed therewith.

(2) Description of the Prior Art

Walls enclosing shafts such as air return shafts, elevator shafts, and stairwell shafts commonly separate the shafts from other rooms such as corridors, toilets, and utility rooms. With increasing governmental concern for promoting safety for occupants of public buildings, manufacturers of building products have sought to provide shaft walls meeting at least minimal safety requirements, while at the same time, providing builders with materials that are both easy to install and low in cost.

Two of the most important of these safety requirements concern wind loading and fire ratings. Destructive wind loading is of particular concern where the shaft is an air return shaft or an elevator shaft, where pressures or vacuums are developed which load the shaft wall up to 15 pounds per square foot in excess of atmospheric pressure.

Cavity walls, and particularly those utilized for enclosing elevator shafts, stairwells, and air return shafts, are continually being subjected to increasingly stringent fire code requirements. The trend is to require such walls to meet or surpass certain fire ratings measured pursuant to ASTM E-119 Fire Rating Test. Elevator shaft walls require, for example at least a 2-hour rating. Where the wall system is "unbalanced", increasingly, code enforcement organizations are requiring that the rating be achieved from both sides of the wall. To pass such tests, each transfer through the metal studs used to construct such walls must be substantially reduced. At the same time, however, the stud must still retain a sufficient degree of structural strength, and in addition, must meet economic requirements. Moreover, the engagement of the stud with the wall panels which they support must be of such nature that construction is achieved with a minimum of required labor and materials. The structure must, nevertheless, withstand the requirements of accurate and complete engagement of the panels and studs, to ensure that the fire rating will be achieved.

The above fire problems concerning shafts can also be said to apply to long corridors in buildings, which in effect are horizontal, rather than vertical, shafts. Thus, without adequate fire ratings, a corridor wall easily transmits the fire throughout the floor as the fire proceeds along the corridor.

To solve these and other problems, early building shaft walls were commonly built up and lined with various types of block masonry, including both concrete and gypsum block. While block masonry has proved suitable for many applications, it has been found to be undesirable in those situations where the shaft rises to great heights. Further, block masonry structures cannot withstand high wind loading. Because of their great weight, concrete block masonry materials require supporting structures of great weight and strength. An additional problem is that these heavy materials give rise to problems in their installation. Those skilled in installing the above-described shaft lining materials are forced to handle them at dangerously high levels.

Walls of the type described and related structures have been disclosed in the prior art, and particularly in U.S. Pat. Nos. 3,740,912, 3,702,044, 3,609,933, 3,016,116, 3,094,197, 999,752, 3,495,417, 3,271,920, 3,839,839, and many others. However, even though many of the structures disclosed in these patents have proven to be highly satisfactory, the search has continued to provide wall structures of the type described of greater strength, and greater fire-retardant properties.

SUMMARY OF THE INVENTION

It is accordingly, an object of the invention to provide a stud for the construction of a cavity shaft wall for multi-story buildings, which walls meet safety standards of wind loading.

It is a further object to provide a stud for the production of a cavity shaft wall, which wall can meet required fire-rating tests even when utilizing relatively thin wallboard panels.

It is an additional object to provide a stud for the production of a cavity shaft wall which is relatively inexpensive, lightweight, and relatively easy to install.

It is a further object to provide a building structure utilizing studs of the type described wherein both layers of wallboard panels can be inserted from the outside or corridor side, thereby obviating the need for workmen to erect scaffolding and to work within an elevator shaft around which the shaft wall is being installed.

Other objects and advantages will become apparent upon reference to the drawings and detailed description.

According to the invention, a fire-rated cavity shaft wall structure is provided utilizing a plurality of metal studs according to the invention and a plurality of wall panels disposed to form two spaced-apart rows with each of the panels having two opposed vertical edges, a stud being interposed between adjacent panels and mounting the panels. Each of the studs has a web portion formed of a single layer of metal, a first pair of oppositely directed flanges provided at one edge of the web, and a second pair of oppositely directed flanges provided at the other end of the web. Each pair of flanges comprises one flange formed of a double layer of sheet metal folded over on itself on one side of the web and extending beyond the web to form a single layer flange. The two pairs of the flanges cooperate to define a pair of oppositely directed channels receiving the ends of a pair of adjacent panels of one layer of wallboard panels and restraining the panels in three directions. Each stud additionally has a supporting panel spaced-apart from the flanges supporting the first wallboard panel layer with a second layer of wallboard panels affixed thereto in spaced-apart relationship from the first layer of wallboard panels. Additionally, in an improved embodiment the web connecting the flanges defining the oppositely directed channels for engaging the edges of the first layer of wallboard panels may be provided with apertures to improve the fire-rating properties of the wall structure.

DESCRIPTION OF THE PREFERRED EMBODIMENTS

Figure 1:
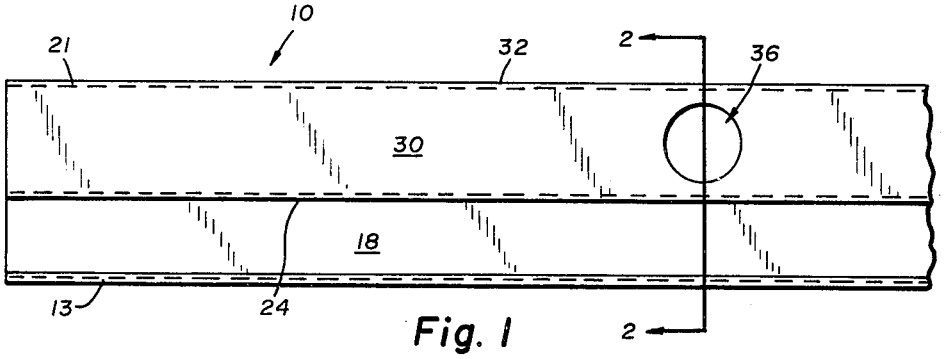
FIG. 1 is a side elevational view of a stud according to the invention.
Figure 2:
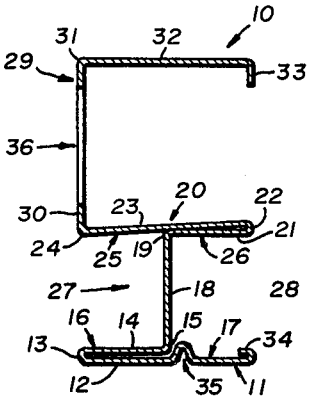
FIG. 2 is a cross-sectional view taken at the line 2—2 of FIG. 1, looking in the direction of the arrows.

Referring to FIGS. 1 and 2, a stud 10 is shown formed of a unitary integral sheet of metal such as steel or aluminum. The stud comprises a first flange-forming panel 11 comprising an outer panel member 12 terminating at a first fold 13, and an inner panel member 14 connected to the first fold 13 and folded over onto the said outer panel member 12 and extending to a second fold 15 thereby defining a pair of oppositely directed flanges 16 and 17.

A web 18 is connected at the second fold and extends substantially perpendicularly with respect to the outer panel member 12 to a third fold 19. A second flange-forming panel 20 comprises an inner panel member 21 connected at said third fold 19 and extending substantially perpendicular thereto to a fourth fold 22. An outer panel member 23 is connected at the fourth fold 22 and is folded over against the inner panel member 21 and extends beyond the web 18 to a fifth fold 24, thereby defining a pair of oppositely directed flanges 25 and 26. The flanges 16 and 17 cooperate with the flanges 25 and 26 and with the web 18 to define a pair of oppositely directed channels 27 and 28.

The stud 10 additionally is provided with supporting means 29 for a second layer of wallboard panels and comprises a supporting web 30 connected at the fifth fold 24 and extending away from the first and second flange-forming panels 11 and 20 and terminating in a sixth fold 31. A wallboard-supporting panel 32 is connected at the sixth fold 31 and extends substantially parallel to the first and second flange-forming panels 11 and 20. The wallboard-supporting panels 32 must have its outward face free of appendages extending away from the face in order to permit one or more wallboard panels to be affixed across the entire face of the panel 32. The panel 32 is provided with a turned-over edge 33, and the outer panel member 12 may be provided with a turned-over edge 34 in order to increase structural rigidity. Additionally, in a preferred embodiment, a groove 35 may be provided in the outer panel member 12 in order to increase structural rigidity thereof. Additionally, a conventional circular aperture 36 may be provided in the supporting web 30 to permit cables and ducts to pass through the stud.

Figure 3:
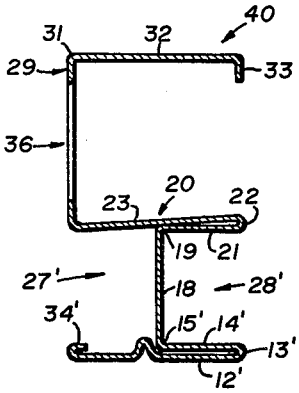
FIG. 3 is a cross-sectional view of an alternative embodiment of the invention, having the folded over flanges reversed into juxtaposed position.

In the studs shown in FIGS. 1 and 2 the folded over flanges 16 and 26 are on opposite sides of the web 18. This is the preferred arrangement since it permits expansion of both channels 27 and 28 at the situs of the folded over flanges. However, where such expansion is not absolutely necessary, the stud 40 shown in FIG. 3 may be utilized. In this figure the same numerals are utilized for identical structures while prime numerals are utilized to show the structures which are reversed. As can be seen, in addition to the identical structures, the stud 40 comprises an outer panel member 12′ extending to a fold 13′, and an inner panel member 14′ extending to the second fold 15′ and web 18. In this structure the channel 27′ has the advantage of double expansion, whereas the channel 28′ is provided with no expansion at the folds 22 and 13′, but has limited expansion at the folds 15′ and 19.

Figure 4:
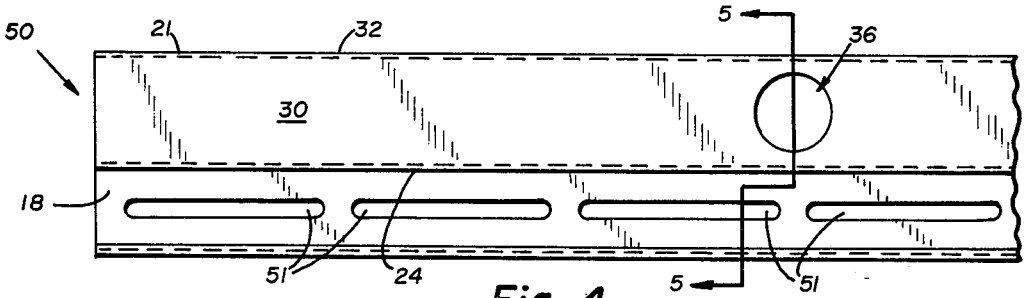
FIG. 4 is an elevational view of a stud comprising still another embodiment of the invention.
Figure 5:
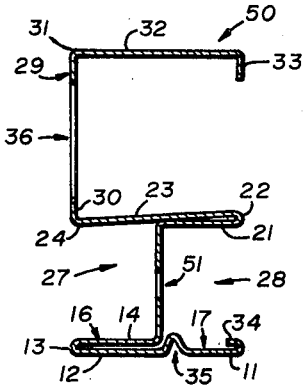
FIG. 5 is a cross-sectional view taken at the line 5—5 of FIG. 4.

Referring to FIGS. 4 and 5, a modified embodiment of the invention is shown. This embodiment is similar to that shown in FIGS. 1 and 2, and identical structures are designated with the same numerals as in FIGS. 1 and 2. In addition to the structure of FIGS. 1 and 2 described above, the stud 50 of FIGS. 4 and 5 is provided with elongate apertures 51 in the web 18. The apertures are somewhat similar to those shown in copending application Ser. No. 483,751, filed June 27, 1974 by the present inventor and now abandoned. As disclosed therein, the apertures have several functions. First, they break up the heat conduction path transversely through the web. Second, they facilitate heat dissipation into the wallboards, and enhance the fire-rating properties of a wall formed from a plurality of the studs. Although only a single row of apertures has been shown in the structure of FIGS. 4 and 5, if desired, two or more rows, with the apertures in staggered relationship may be utilized in the web. Additionally, if desired, apertures may be placed in the outer panel member 23 and in the inner panel member 21.

Figure 6:
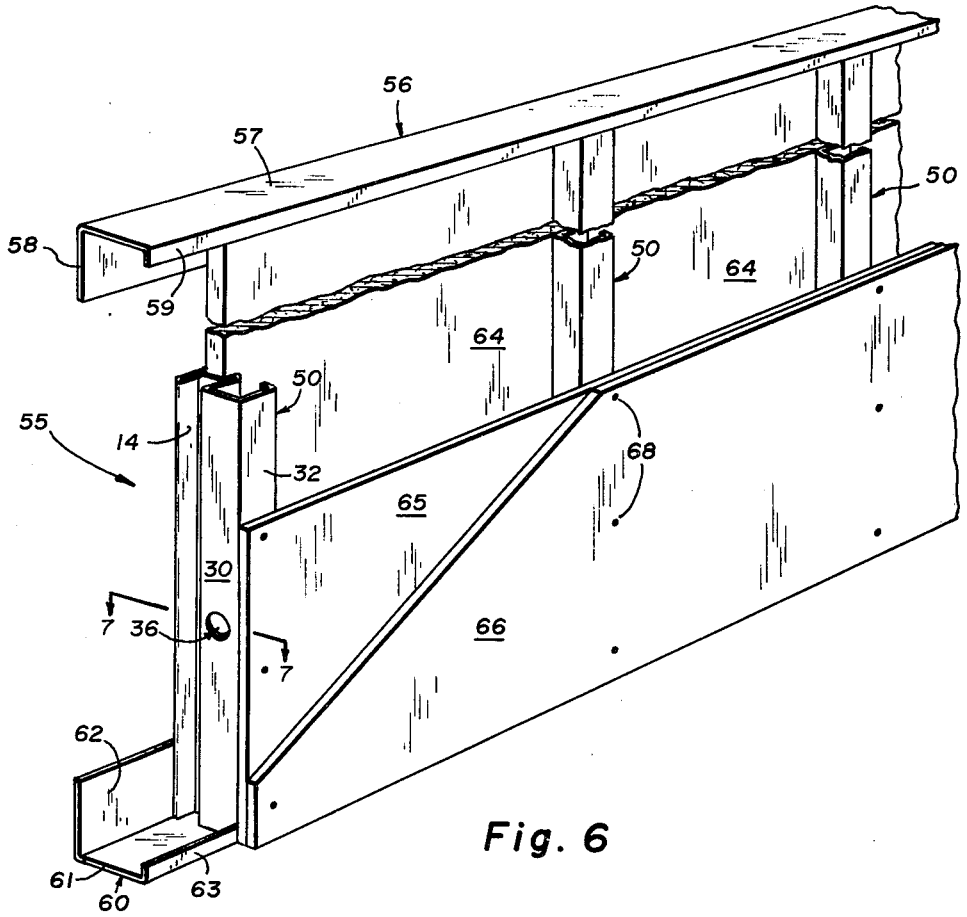
FIG. 6 is a perspective view of a portion of a cavity shaft wall embodying the stud of FIGS. 1 and 2.
Figure 7:
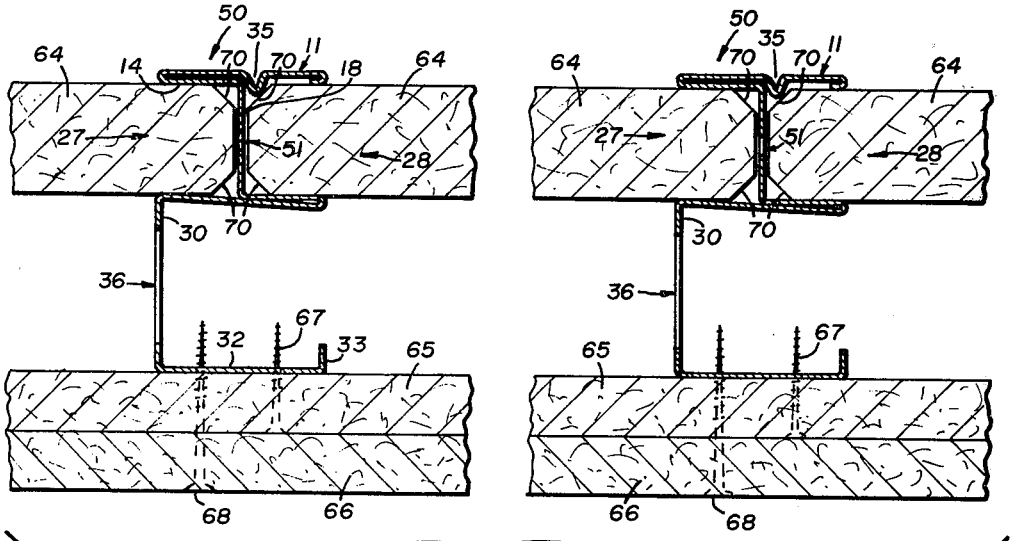
FIG. 7 is a fragmentary cross-sectional view taken at the line 7—7 of FIG. 6, looking in the direction of the arrows.

Referring to FIGS. 6 and 7, a wall structure is shown utilizing studs 50 similar to those shown in FIGS. 4 and 5, and having elongate apertures 51 provided in the web 18 of each stud. The structure is in the form of a cavity shaft wall structure 55 suitable for assembly from the outer or corridor side with respect to the cavity around which the wall is assembled, and comprises an upper J-runner 56 having a web 57, a major or large flange 58 on the shaft side and a minor or smaller flange 59 on the outer wall side. The runner 56 may be affixed to a ceiling structure. On the floor structure is mounted a lower J-runner 60 having a web 61, a major flange 62 on the shaft side and a minor flange 63 on the outer or corridor side. A plurality of studs 50 having a structure similar to that shown in FIGS. 4 and 5 are mounted inside the runners 56 and 60. As shown in FIGS. 6 and 7, a layer or row of gypsum wallboard or liner panels 64 is retained within the channels 27 and 28 of each stud and restrained in three directions by the web 18 and the flanges 16, 17, 25 and 26. The liner panels 64 are provided with beveled corners 70 to facilitate insertion into the channels 27 and 28, and additionally, to clear the grooves 35 of the studs. A first outer layer of wallboard panels 65 is affixed to the wallboard-supporting panels 32 of each stud by means of screws 67. A second layer of outer wallboard panels 66 is affixed to the first layer of panels 65 and the studs 50 by means of screws 68.

In erecting the wall, because of the structure of the J-runners and studs, the entire wall may be assembled from the outside or corridor side of the shaft without the need for placing workmen on scaffolding within the shaft to assemble any portion of the wall from the shaft side. In assembling the wall the runners 56 and 60 are first affixed to the ceiling and floor structures. A stud 50 is then inserted between the flanges of the runners and maintained in place by the flanges. The flanges may be screwed to the studs if desired. A wallboard panel 64 is then set into place with its bottom edge within the lower runner, and the upper edge is swung into place into the upper runner. The minor flange 59 is sufficiently narrow so that the upper edge of the wallboard panel 64 clears the flange and comes to rest against the major flange 58. It can then be moved laterally to become engaged within the channels 27 and 28. A second stud is then mounted between the runners and moved laterally until the opposite vertical edge of the panel 64 is engaged within one of the channels 27 or 28. Then another stud is inserted. This process continues until the entire inner wall is erected. The first outer wallboard panels 65 are then placed against the wallboard-supporting panel 32 of the studs and affixed in place by means of screws 67. The second layer of outer wallboard panels 66 is then placed against the first layer of panels 65 and affixed thereto and to the stud by means of screws 68.

A fire-rating test was carried out with the structure of FIGS. 6 and 7 in conformity with ASTM E-119, *Fire Tests of Building Construction and Materials.* The test was carried out utilizing studs as shown in FIGS. 4–7 and formed of galvanized sheet steel having a thickness of 0.017 to 0.018 in. J-runners were formed of galvanized sheet steel as shown in FIGS. 6 and 7 having a thickness of 0.025 in. Gypsum shaft wall liner panels 64 were 1-in. nominal by 23 $\frac{7}{8}$ inch, and having an actual thickness of 1.047 in. and a weight of 4260 lb. per 1000 sq. ft. The gypsum wallboard panels 65 and 66 were $\frac{1}{2}$ by 48 in. gypsum wallboard Fire Code C, having an actual thickness of 0.514 in. and weighing 2100 lb. per 1000 sq. ft. The studs were placed at 2 feet on centers, and were installed with the flanges 16 and 17 on the shaft side of the wall having a $\frac{1}{4}$ in. clearance at each end to allow for expansion. The one inch shaft wall liner panels were cut 1 in. short of the 10 ft. wall height so that they could be lifted over the 1 in. flange on the corridor side of the "J" runner. The shaft wall liners were firmly pressed into the 1 in. channels or grooves 27 and 28 of the studs. At each end of the 12 ft. wall the shaft wall liner was fastened to the "J" runner using 1 $\frac{5}{8}$ in. screws, 12 in. o.c. Two plies of $\frac{1}{2}$ in. by 48 in. Sheetrock Fire-code gypsum panels were installed on the corridor side of the wall using 1 in. type S screws at 24 in. in the base ply and 1 $\frac{5}{8}$ in. type S screws at 12 in. in the studs and runners for the face ply. Vertical joints in the face ply were staggered 2 ft.; then the joints in the face ply were covered with paper tape and two coats of joint compound.

The test furnace comprised a reinforced concrete frame lined with refractory material and having a door opening 12 ft. 1 in. wide by 11 ft. 0 in. high. The door itself comprised a steel frame of heavily reinforced 15 in. 42.9 lb. I-beams, 12 ft. 9 in. clear horizontally and 11 ft. 4 in. clear vertically, but lined with fire-resistant material at top and sides, the bottom being a brick covered steel beam adjusted to give a net clear opening 12 ft. 1 in. wide by 10 ft. 0 in. high. The furnace door was suspended from two trolleys running along a 15 ft. I-beam, so arranged that the door could be moved clear of the furnace to permit installation of the test panel in the door frame and to permit making the standard hose-stream test upon completion of the fire-resistance test without any interference from the furnace itself. Various brackets were utilized for anchoring wall specimens into the frame. A clamping system was provided to hold the frame against an asbestos gasket on the furnace face.

The furnace was arranged to be fired by 44 gas burners with the temperature being maintained in accordance with the standard time-temperature curve as specified by ASTM Designation E-119. Nine thermocouples were installed in the combusiton space, one in the center, one 2 ft. from each corner, and one near the middle of each edge of the panel, but 2 ft. therefrom, so that the range of temperature and the average temperature can be accurately determined.

Temperatures of the unexposed face of the walls were obtained by nine thermocouples held securely against the surface at spaced locations, conforming to ASTM requirements.

Four walls were tested, one being subjected to a two hour fire on the shaft side, the second to a two hour fire on the corridor side, the third to a one hour fire and hose-stream test on the shaft side, and the fourth to a one hour fire and hose-stream test on the corridor side.

The results of these tests made in conformity with ASTM E-119, demonstrated that the wall made according to the invention and as described above resisted a two hour fire test on either side, and resisted a one hour fire and standard hose-stream test on either side. Such excellent results cannot be obtained with convention wall systems utilizing only $\frac{1}{2}$ inch board on the corridor side.

Figure 8:
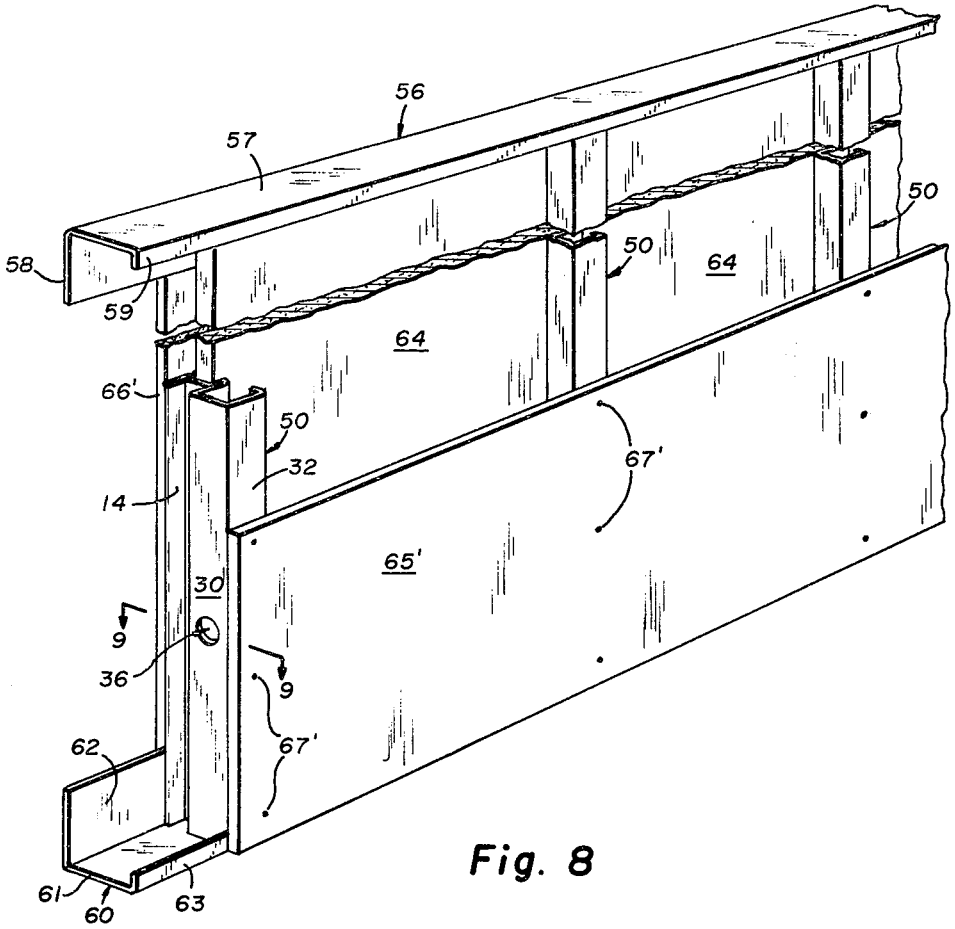
FIG. 8 is a perspective view of a portion of a cavity shaft wall suitable for use in stairwells.
Figure 9:
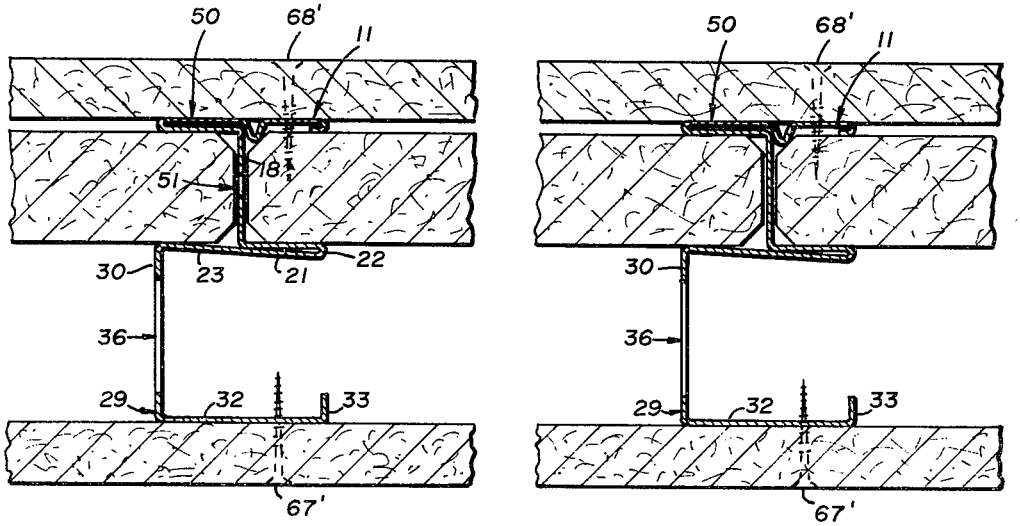
FIG. 9 is a fragmentary cross-sectional view taken at the line 9—9 of FIG. 8, looking in the direction of the arrows.

Referring to FIGS. 8 and 9, a modified embodiment of the structure shown in FIGS. 6 and 7 is illustrated. This structure is in most respects identical to that shown in FIGS. 6 and 7 and identical numeral designations have been utilized to refer to identical structure. However, the structure of FIGS. 8 and 9 differs in that only a single wall board panel 65' is provided at the corridor side, and a similar wall board panel 68', instead of being placed over the panel 65', is affixed to the flanges 16 and 17 by means of screws 68'. This structure provides a finished wall on both sides and is useful for such applications as for stair cases. The structure was subjected to the fire test described above with respect to the structure of FIGS. 6 and 7, and successfully passed the two hour fire test and also the 1 hour fire and standard hose-stream test on both sides.

The studs of the present invention have many advantages over those disclosed in the prior art. First, they are considerably less expensive to produce than many of the prior art studs. Second, when studs according to FIGS. 4 and 5 having venting apertures in the web are utilized with a structure such as shown in FIGS. 6 and 7, and in FIGS. 7 and 8, they enable a shaft wall structure to be produced which, even when only $\frac{1}{2}$ inch gypsum panels 65 and 66 are utilized, to obtain successfully a 2 hour fire-rating and a one hour fire and standard hose-stream test. Further, when utilized with J-runners, as shown in FIGS. 6 and 8, the entire structure may be erected from the corridor side, without the need for scaffolding to be erected to enable work to be carried out on the shaft side. Another advantage results from the fact that the flanges defining the channels 27 and 28 are continuous along substantially their entire length in the direction longitudinally with respect to the stud. Consequently, it is relatively simple to insert the edges of liner panels into the channels. In certain prior art structures some of the flanges defining the channels are formed from a plurality of tabs which are separated from each other and therefore the flange is discontinuous. In such structures, the sharp corners of the tabs tend to catch the edges of the liner panels and to impede their insertion into the channels. A further advantage is that, because of the fold structure defining the flanges, particularly in the embodiment of FIGS. 1 and 2 wherein the folds 13 and 22 are oppositely disposed, each channel has one flange formed of a folded over structure, resulting in a spring action whereby the edges of the panels may expand the springable flanges where necessary in the event the panels are somewhat oversized in thickness.

It is to be understood that the invention is not to be limited to the exact details of operation or structure shown and described in the specification and drawings, since obvious modifications and equivalents will be readily apparent to one skilled in the art.

What is claimed is:

1. A stud adapted for use in constructing a wall comprised of a pair of spaced-apart coplanar layers of gypsum wallboard panels, the panels of each layer being in abutting relationship, said wall having a plurality of said studs interposed between said layers of wallboard panels and affixed thereto, said stud being formed of a unitary integral sheet metal structure and comprising:

(A) A first wallboard panel layer-engaging structure comprising:

(1) a first flange-forming panel comprising (a) an outer panel member extending to a first fold, and (b) an inner panel member connected at said first fold and folded over a surface of said outer panel member and extending to a second fold intermediate the edges of said outer panel member, thereby forming a pair of flanges one on each side of said second fold, (2) a web connected at said second fold and extending away from said first flange-forming panel disposed substantially perpendicular thereto and terminating at a third fold, and (3) a second flange-forming panel positioned substantially parallel to said first flange-forming panel comprising:

(a) an inner panel member connected at said third fold and extending substantially perpendicular to said web to a fourth fold, and (b) an outer panel member connected at said fourth fold and folded over said inner panel member and extending beyond said web to a fifth fold, thereby forming a pair of flanges one on each side of said web with each flange being continuous along substantially the entire length of said stud, said first and said second flange-forming panels and said web cooperating to form an H-shaped structure in cross-section defining oppositely directed channels for receiving and restraining adjacent wallboard panels in three directions; and (B) means for supporting a second layer of gypsum wallboard panels spaced apart from said first layer of panels comprising:

(1) a supporting web connected at said fifth fold and extending away from said second flange-forming panel and terminating in a sixth fold, and (2) a wallboard-supporting panel connected at said sixth fold extending in a direction substantially parallel to and spaced-apart from said first and second flange-forming panels and having its outer surface free of apendages, thereby being adapted to permit said second layer of panels to extend across and be affixed to the entire outer surface of said supporting panel.

2. A stud according to claim 1, wherein said first fold and said fourth fold are on opposite sides of said web.

3. A stud according to claim 1, wherein said first fold and said fourth fold are on the same side of said web.

4. A stud according to claim 1, wherein a longitudinal groove is provided in a median portion of the outer panel member of said first flange-forming panel for providing structural rigidity.

5. A stud according to claim 1, wherein said web connected at said second fold respectively is provided with a plurality of apertures.

6. A stud according to claim 5, wherein said apertures are elongate and arranged in a row.

7. A stud according to claim 1, wherein a flange is provided on said wallboard-supporting panel to increase structural rigidity.

8. A stud according to claim 1, having apertures provided in said supporting web to permit passage of conduits, wires and pipes.

9. A fire-retardant wall comprising in combination:

(I) upper and lower runners (II) a plurality of studs mounted in said runners, each of said studs comprising:

(A) A first wallboard panel layer-engaging structure comprising:

(1) a first flange-forming panel comprising:

(a) an outer panel member extending to a first fold, and (b) an inner panel member connected at said first fold and folded over a surface of said outer panel member and extending to a second fold intermediate the edges of said outer panel member, thereby forming a pair of flanges one on each side of said second fold, (2) a web connected at said second fold and extending away from said first flange-forming panel disposed substantially perpendicular thereto and terminating at a third fold, and (3) a second flange-forming panel positioned substantially parallel to said first flange-forming panel comprising:

(a) an inner panel member connected at said third fold and extending substantially perpendicular to said web to a fourth fold, and (b) an outer panel member connected at said fourth fold and folded over said inner panel member and extending beyond said web to a fifth fold, thereby forming a pair of flanges one on each side of said web with each flange being continuous substantially along the entire length of said stud, said first and said second flange-forming panels and said web cooperating to form an H-shaped structure in cross-section defining oppositely directed channels for receiving and restraining the edges of a first row of adjacent gypsum wallboard panels in three directions; and (B) means for supporting a second row of gypsum wallboard panels spaced apart from said first row of panels comprising:

(1) a supporting web connected at said fifth fold and extending away from said second flange-forming panel and terminating in a sixth fold, and (2) a wallboard-supporting panel connected at said sixth fold extending in a direction substantially parallel to and spaced-apart from said first and second flange-forming panels and having its outer surface free of apendages, thereby being adapted to permit said second row of panels to extend across and be affixed to the entire outer surface of said supporting panel, (III) a first row of gypsum wallboard panels, the edges of adjacent panels being engaged and retained within the oppositely directed channels of said studs, and (IV) a second row of gypsum wallboard panels engaged by and affixed to said wallboard supporting panels in substantially parallel spaced-apart relationship with respect to said first row.

10. A wall according to claim 9, wherein a third layer of gypsum wallboard panels is affixed to said second layer of wallboard panels.

11. A wall according to claim 9, wherein a third layer of gypsum wallboard panels is affixed to said first layer of wallboard panels.

12. A wall according to claim 9, wherein the web connected at said second fold respectively of each stud is provided with a plurality of apertures.

13. A wall according to claim 12, wherein said apertures are elongate and arranged in a row.

14. A wall according to claim 9, wherein the first fold and the fourth fold of each stud are on opposite sides of said web.

15. A wall according to claim 9, wherein the first fold and fourth fold of each stud are on the same side of said web.

16. A wall according to claim 9, wherein a longitudinal groove is provided in a median portion of the outer panel member of said first flange-forming panel of each stud for providing structural rigidity.

17. A wall according to claim 9, wherein a flange is provided on the wallboard-supporting panel of each stud to increase structural rigidity.

18. A wall according to claim 9, wherein apertures are provided in the supporting web of each stud to permit passage of conduits, wire and pipes.

19. A wall according to claim 9, wherein the corners of the vertical edges of each panel of said first layer are beveled to facilitate their insertion into said oppositely directed channels.

* * * * *